US010030921B1

(12) United States Patent
AlSadah et al.

(10) Patent No.: US 10,030,921 B1
(45) **Date of Patent: *Jul. 24, 2018**

(54) ONLINE HEAT EXCHANGER CLEANING SYSTEM WITH CONNECTED CLEANING ELEMENTS

(71) Applicant: King Fahd University of Petroleum and Minerals, Dhahran (SA)

(72) Inventors: Jihad Hassan AlSadah, Dhahran (SA); Esmail M. A. Mokheimer, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/928,822

(22) Filed: Mar. 22, 2018

Related U.S. Application Data

(63) Continuation of application No. 14/523,201, filed on Oct. 24, 2014.

(51) Int. Cl.

| | |
|---|---|
| ***F28G 3/04*** | (2006.01) |
| ***F28G 15/08*** | (2006.01) |
| ***F28G 15/04*** | (2006.01) |
| ***F28G 15/02*** | (2006.01) |
| ***F28G 7/00*** | (2006.01) |
| ***F28G 1/16*** | (2006.01) |
| ***A46B 13/02*** | (2006.01) |
| ***B08B 9/053*** | (2006.01) |

(52) U.S. Cl.

CPC ..... *F28G 3/04* (2013.01); *A46B 13/02* (2013.01); *B08B 9/0535* (2013.01); *F28G 1/16* (2013.01); *F28G 7/00* (2013.01); *F28G 15/02* (2013.01); *F28G 15/04* (2013.01); *F28G 15/08* (2013.01)

(58) Field of Classification Search
None
See application file for complete search history.

(56) References Cited

U.S. PATENT DOCUMENTS

| | | | |
|---|---|---|---|
| 812,361 | A | 2/1906 | Pickles |
| 4,174,750 | A | 11/1979 | Nichols |
| 4,515,747 | A | 5/1985 | Creek et al. |
| 4,972,805 | A | 11/1990 | Weems |
| 5,755,002 | A | 5/1998 | Lacy |
| 5,983,994 | A | 11/1999 | Tsou |
| 8,225,848 | B2 | 7/2012 | Cottard |
| 8,308,869 | B2 | 11/2012 | Gardner et al. |
| 2008/0185126 | A1 | 8/2008 | Jiang |
| 2010/0307604 | A1 | 12/2010 | German |
| 2012/0216833 | A1 | 8/2012 | Wang |

FOREIGN PATENT DOCUMENTS

| | | | |
|---|---|---|---|
| CN | 100573026 | C | 12/2009 |
| WO | WO 2011/126579 | A1 | 10/2011 |

*Primary Examiner* — Nicole Blan
(74) *Attorney, Agent, or Firm* — Oblon, McClelland, Maier & Neustadt, L.L.P.

(57) ABSTRACT

An online cleaning system for tube and shell heat exchangers is presented. The system includes a positioner, a plunger, an umbilical cleaner, and a motor. The cleaning system cleans the tubes while the heat exchanger remains in operation. The cleaning system locates and isolates a single tube via rotating and translating mechanical actions and inserts the umbilical cleaner into the tube, which may clean the tube via rotational movement or via sonication. The cleaning system may further clean the outer surface of the tubes of the heat exchanger.

7 Claims, 15 Drawing Sheets

ONLINE HEAT EXCHANGER CLEANING SYSTEM WITH CONNECTED CLEANING ELEMENTS

CROSS-REFERENCE TO RELATED APPLICATIONS

The present application is a Continuation of Ser. No. 14/523,201, now allowed, having a filing date of Oct. 24, 2014.

STATEMENT OF ACKNOWLEDGEMENT

This project was funded by the National Plan for Science, Technology and Innovation (MAARIF AH)—King Abdulaziz City for Science and Technology—the Kingdom of Saudi Arabia, award number (10-WAT1397-04).

BACKGROUND OF THE INVENTION

Technical Field

The present invention relates to an online cleaning system used to clean a tube and shell heat exchanger including a cleaning system comprising a positioner, a plunger, an umbilical cleaner, and a motor. The cleaning system uses a tube that contains both rotating and translating mechanical actions and cleans while the heat exchanger is in operation.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

There are several types of heat exchangers used in various industries. A common type is known as a shell and tube type. Modern shell and tube exchangers are of several types, including: (1) a straight through version where the heat exchange tubes are generally straight, (2) a U-tube version where the heat exchange tubes are bent into a U so the inlets and outlets of the heat exchange tubes pass through the same tube sheet and open into compartments provided by a channel and (3) a floating head type where the inlets and outlets are at one end of the exchanger, the tubes are straight and open, at the opposite end of the exchanger, into a floating head or manifold that directs flow back toward the outlet. U-tube type heat exchangers have a cost advantage because only one set of inlet/outlet channels is required. Straight through heat exchangers are typically selected when the tube side fluid deposits materials in the tube or is corrosive because it is usually more difficult to clean the curve in a U-tube type.

Fixed-tube-sheet exchangers are used more often than any other type. The tube sheets are welded to the shell. Usually these extend beyond the shell and serve as flanges to which the tube-side headers are bolted. This construction requires that the shell and tube-sheet There is no limitation on the number of tube-side passes. Shellside passes can be one or more, although shells with more than two shell-side passes are rarely used.

Tubes can completely fill the heat-exchanger shell. Clearance between the outermost tubes and the shell is only the minimum necessary for fabrication. Between the inside of the shell and the baffles some clearance must be provided so that baffles can slide into the shell. Fabrication tolerances then require some additional clearance between the outside of the baffles and the outermost tubes. The edge distance between the outer tube limit (O.T.L.) and the baffle diameter must be sufficient to prevent vibration of the tubes from breaking through the baffle holes. The outermost tube must be contained within the O.T.L. Another type of shell and tube heat exchanger is a U-tube heat exchanger. In a U-tube heat exchanger, the tube bundle consists of a stationary tube sheet, U-tubes (or hairpin tubes), baffles or support plates, and appropriate tie rods and spacers. The tube bundle can be removed from the heat-exchanger shell. A tube-side header (stationary head) and a shell with integral shell cover, which is welded to the shell, are provided. Each tube is free to expand or contract without any limitation being placed upon it by the other tubes.

The U-tube bundle has the advantage of providing the minimum clearance between the outer tube limit and the inside of the shell for any of the removable-tube-bundle constructions. Clearances are of the same magnitude as for fixed-tube-sheet heat exchangers.

The number of tube holes in a given shell is less than that for a fixed-tube-sheet exchanger because of the limitations on bending tubes of a very short radius.

The performance of shell and tube heat exchangers degrades over time by the deposition of solids from the tube side flow onto the inside wall of the heat exchanger tubes. This is commonly referred to as tube side fouling and can significantly impair the performance of heat exchangers. Fouling deposits act as an insulator and thereby reduce heat transfer across the walls of the tubes. This fouling can also cause increased pressure drops across the tubes thereby decreasing flow through the tubes. Under certain conditions, these deposits can also promote corrosion of the inside of the tube wall, a phenomenon known as under-deposit corrosion. This corrosion, if left unchecked, can produce leak paths through the tube wall allowing commingling of the heat exchange fluid and the process fluid. Even though tube side fouling is a persistent maintenance problem, it is much preferred to shell side fouling because it is much easier to clean and inspect the interior of the heat exchange tubes as compared to the outside. For this reason, in situations where one of the two fluids is more corrosive or more prone to produce deposits in the heat exchanger, this fluid may preferably be put through the tubes rather than through the shell.

Over time, heat exchangers tend to develop residue on the surfaces of the tubes, tube sheets, tube support plates and other internal structural parts. The residue can comprise adherent films, scales, sludge deposits, corrosion and/or other similar materials. Over time, this residue can have an adverse affect on the operational performance of the exchangers. The same problem can arise for all piping and tubing found in industrial facilities.

Various methods have been developed to clean the inside of heat exchanger tubes to remove deposits. These deposits are often relatively hard and therefore difficult to remove from the tube walls. To effectively clean tube side fouling, the heat exchanger is usually taken off-line and out of service to access and mechanically clean the inside of the tubes. These off-line methods of cleaning include high pressure water cleaning known as hydroblasting, mechanical cleaning using brushes, scrapers or projectiles, and blasting with abrasive media. Once the tubes are cleaned and while the heat exchanger is off-line, the tubes may be inspected to determine if corrosion has thinned or pitted the tube wall and a determination can be made to replace or retain the tube. In some circumstances, the tube may be replaced or simply plugged, i.e. a plug is placed in the tube to block flow through it.

Most inspection techniques require the heat exchanger to be out of service. Cleaning by circulation of abrasive media may conventionally be done while a heat exchanger is in operation by inserting media into the flow entering the tubes and then separating the media from flow out of the tubes. As currently practiced, heat exchangers must be out of service in order to plug a leaking or unserviceable tube. The cost of disassembling and then reassembling the heat exchanger to permit access to the tubes for cleaning and inspection can be significant. More significant in many situations is the lost production cost from taking the heat exchanger and its associated equipment out of service.

Other manual methods involve taking the heat exchanger off-line and out of service to manually clean the tubes. These manual methods of cleaning include: high pressure water cleaning to blast away the deposits, acid cleaning to loosen or dissolve the deposits, or the propulsion of a brush or scraping implement through the tube to scrape off the deposits.

Another common method involves the controlled application of high pressure water and/or chemical streams to the affected areas of the heat exchanger. This method can require the presence of one or more persons at or near the point of application of the high pressure stream to the exchanger during the cleaning process.

For example, an operator may stand in clear view of, and near the line-of-fire of, the high pressure stream to direct the stream to the affected areas of the exchanger. Another person may be needed to operate a control panel next to the exchanger to further control the direction and volume of stream flow. This type of work is extremely labor intensive and potentially hazardous. For example, it may be necessary for crews to manually reposition the device providing the high pressure stream for each cleaning stroke. Further, those persons in close proximity to the cleaning environment can be exposed to high pressure water, hazardous cleaning chemicals or other potentially toxic, poisonous or volatile materials.

All of these manual methods result in the loss of use of the heat exchanger during cleaning and incur the cost associated with the cleaning itself. Furthermore, after cleaning and during operation, the tubes begin to foul and continue fouling resulting in a reduction in heat transfer until the next cleaning. In the case of acid cleaning, pitting and corrosion of the tube may occur.

The costs associated with reduced capacity of heat exchanger tubes can also be substantial in situations where the throughput of process fluids has to be curtailed. In one oil refinery, the estimated lost production costs of reduced throughput from a catalytic cracker due to deteriorating heat exchange performance has been in the range of $500,000/year.

Other methods for cleaning the tubes without taking the heat exchanger out of service include devices which introduce a number of tube cleaners (e.g., balls or brushes) into the fluid which passes through the tubes. The tube cleaners are designed to fit tightly enough into the tube to contact the tube wall while still being pushed through the tube by the fluid pressure. At the outlet of the tube these tube cleaners are collected and recycled back to the tube inlet. In some systems the tube cleaners are propelled through the tube in a direction opposite the fluid flow by reversing the fluid flow temporarily. The number of tube cleaners used and the recycle rate may vary depending upon the cleaning effectiveness desired.

While these on-line systems avoid having to take the heat exchanger out of service, there is significant cost associated with the necessary piping and valving. Further, these methods are prone to plugging of the tube by debris that has been loosened by the tube cleaners. After the tubes have been cleaned the pressure drop across the tube and the heat transfer rate across the tube wall return to their nominal design points.

BRIEF SUMMARY OF THE INVENTION

The foregoing paragraphs have been provided by way of general introduction, and are not intended to limit the scope of the following claims. The described embodiments, together with further advantages, will be best understood by reference to the following detailed description taken in conjunction with the accompanying drawings.

In one embodiment of the present invention a cleaning system used to clean tube and shell heat exchangers (HEX).

In another embodiment, the system includes a positioner, a plunger, and an umbilical cleaner.

In another embodiment, the system cleans the HEX while the heat exchanger remains in operation.

In another embodiment, the system isolates and cleans a single tube at a time while the HEX remains in operation.

In another embodiment, the system further includes a diagnostic tool system to monitor the status of individual pipes in the HEX.

In another embodiment, the diagnostic tool system includes data collection.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
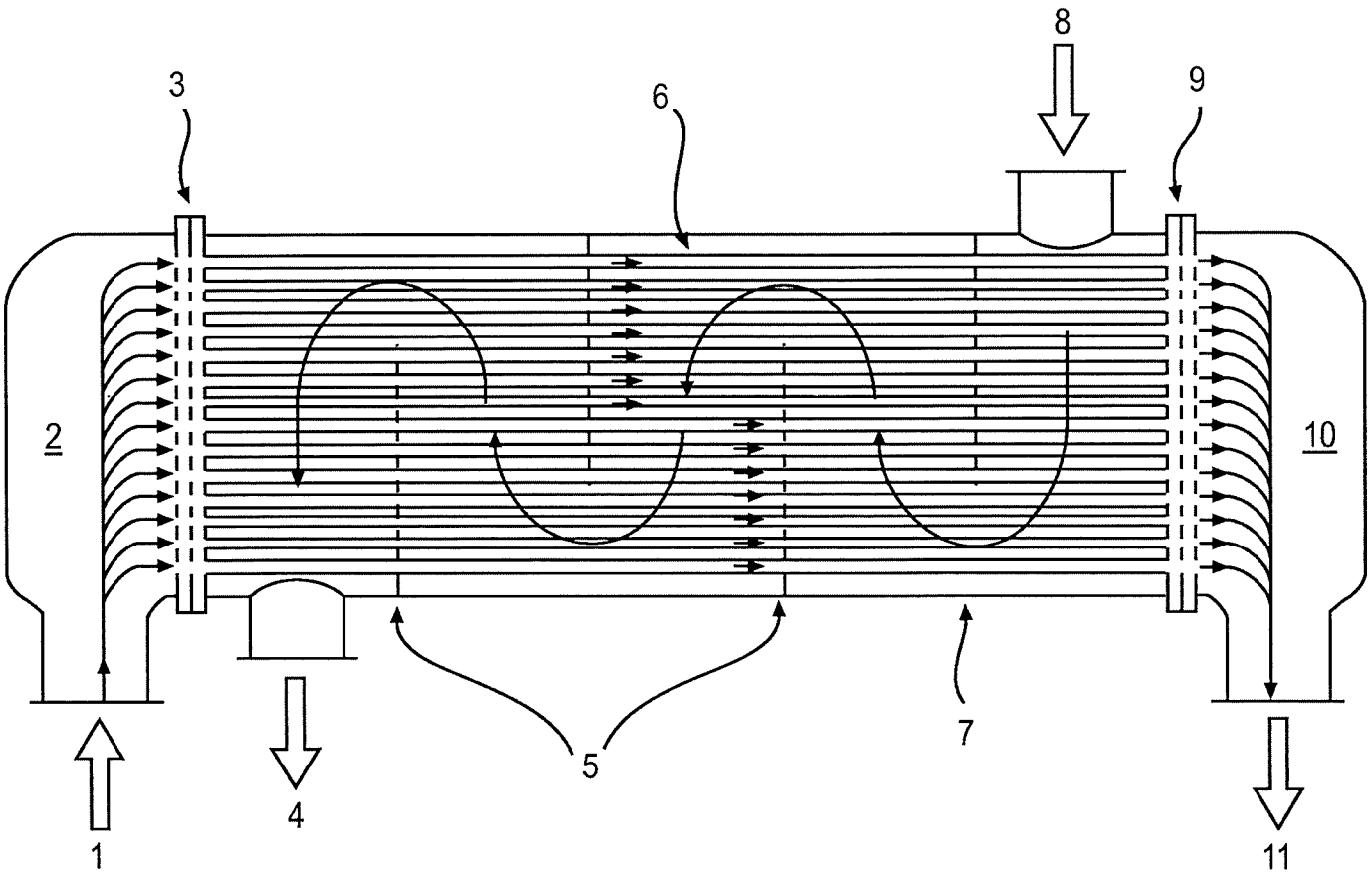
FIG. 1 illustrates a single-pass tube and shell heat exchanger system.

Referring now to the drawings, wherein like reference numerals designate identical or corresponding parts throughout the several views.

The present invention relates to a cleaning system used to clean tube and shell heat exchangers. The cleaning system includes multiple mechanical systems. The cleaning system is an online cleaning system and cleans the tubes in the tube and shell heat exchanger while the heat exchanger remains in use. The system also isolates and cleans the tubes one at a time while the other tubes remain online for the heat exchanger to function.

FIG. 1 illustrates a single-pass tube and shell heat exchanger system. The fluid that flows through the tubes enters through a tube-side 1 into the inlet plenum 2. The fluid then passes through a tube sheet 3 and flows through the straight tube bundles 6. The fluid then passes through a second tube sheet 9 and into the outlet plenum 10 to flow out of the heat exchanger through the passageway 11. The fluid that passes through the inside of the heat exchanger but on the outside of the tubes enters from a shell-side fluid in port 8 and passes through the heat exchanger. Baffles 5 control the flow of the fluid to evenly disperse throughout the heat exchanger and flow in the opposite direction of the fluid flowing through the tubes. The fluid then exits the heat exchanger through a shell-side fluid out port 4.

Figure 2:
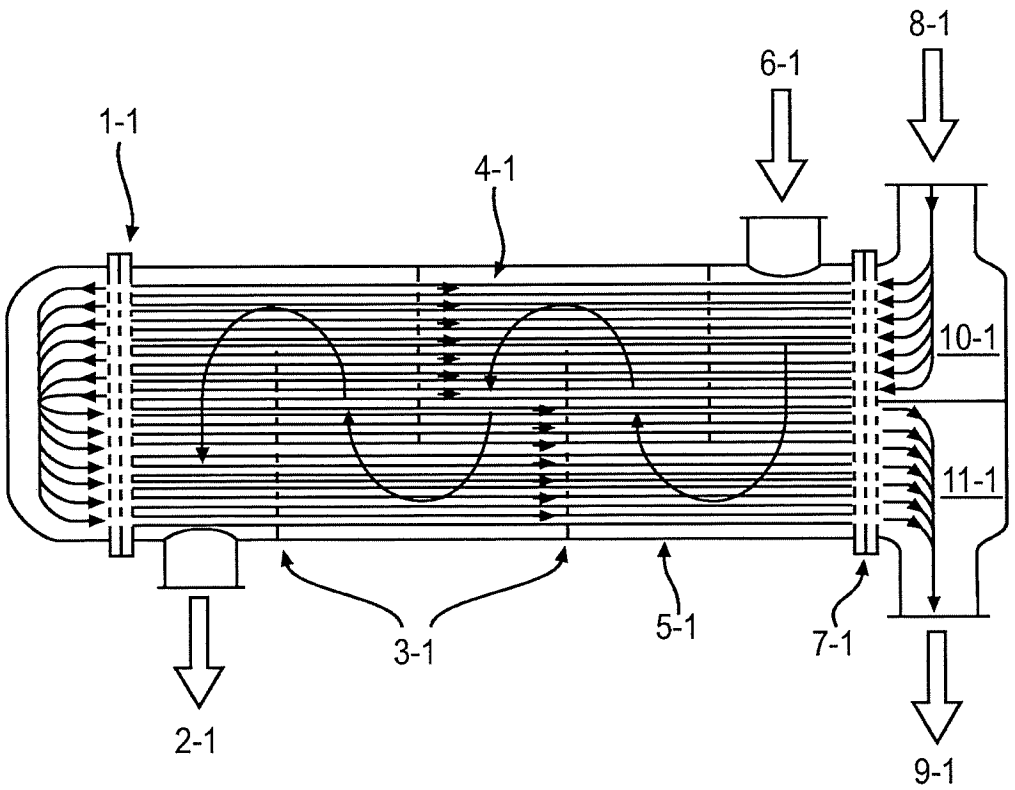
FIG. 2 illustrates a two-pass tube and shell heat exchanger system.

FIG. 2 illustrates a two-pass heat exchanger system. The fluid that flows through the tubes enters through a tube-side fluid in port 8-1 into an inlet plenum 10-1. The fluid then passes through a tube sheet 7-1 and flows through the straight tube bundles 4. The fluid then passes through a second tube sheet 1-1 and recirculates back into the straight tube bundles 4-1, back through the tube sheet 7-1 and into an outlet plenum 11-1 into the tube-side fluid out port 9-1. The fluid that passes through the inside of the heat exchanger but on the outside of the tubes enters from a shell-side fluid in port 6-1. Baffles 3-1 control the flow of the fluid to evenly disperse throughout the heat exchanger. The fluid then exits the heat exchanger through a shell-side fluid out port 2-1

Figure 3:
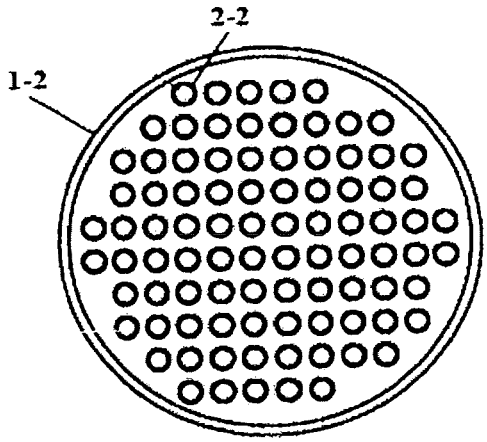
FIG. 3 illustrates a cross-section of a tube and shell heat exchanger.

FIG. 3 illustrates a cross-section of a tube and shell heat exchanger. 1-2 illustrates the shell of the heat exchanger and 2-2 illustrates a specific tube in the heat exchanger. A plurality of tubes are included within the shell of the heat exchanger.

Figure 4A:
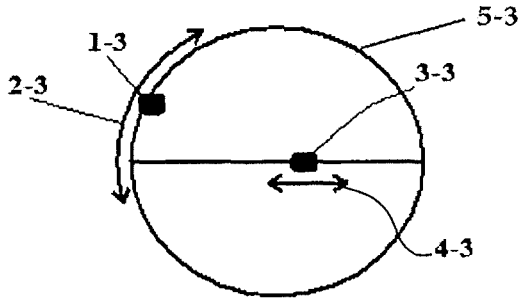
FIGS. 4A-4B illustrates a positioner of the tube and shell heat exchanger cleaning system.
Figure 4B:
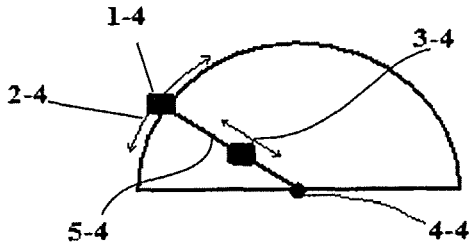

In one embodiment of the invention, the cleaning system comprises a positioning system. FIGS. 4A-4B illustrate a positioning system for either a single-pass system or a two-pass system in a heat exchanger. The tubes of the tube and shell heat exchanger are attached to two base plates, which may be in the shape of disks. FIG. 4A illustrates the positioner in the single-pass heat exchanger system. In a single-pass heat exchanger system, both baseplates of the heat exchanger have an identical design in which the fluids pass each other a single time before separating. When the cleaning system is in use, the positioner allows selection of a particular tube for the cleaning system to clean by an angular selector 1-3 and selector 3-3 having rotational 2-3 and radial 4-3 movements, respectively. The positioner selects the tubes for cleaning by rotation and mechanical translation.

Rotational selection of 2-3 is implemented by attaching an annular rail 5-3 sliding on a fixed rail support. The angular selector 1-3 rotates the annular rail 5-3 to a specified rotational position so that the cleaning system may be inserted into a particular tube of the heat exchanger. The angular selector 1-3 is preferred to be installed at a fixed position. The motor may be electric or hydraulic. The positioner moves the cleaning system to a particular tube. The positioner attaches to the tube in a disk like attachment form. Tube selection moves the plunger to select a tube and then plunge the plunger to start the cleaning process of the tube. The position of any tube in 2D space could be described by selecting coordinates from a coordinate system (r, θ).

The positioner includes a motor 3-3 that may be electric or hydraulic. The motor moves along the straight rail that is positioned across the diameter of the heat exchanger. The straight rail may be singly or doubly formed. Preferably, the straight rail is singly formed.

The hydraulic fluid power motor may be run from the outside of the system and is easier to maintain and safer to operate compared to an electric motor that is immersed inside the fluid.

Figure 5:
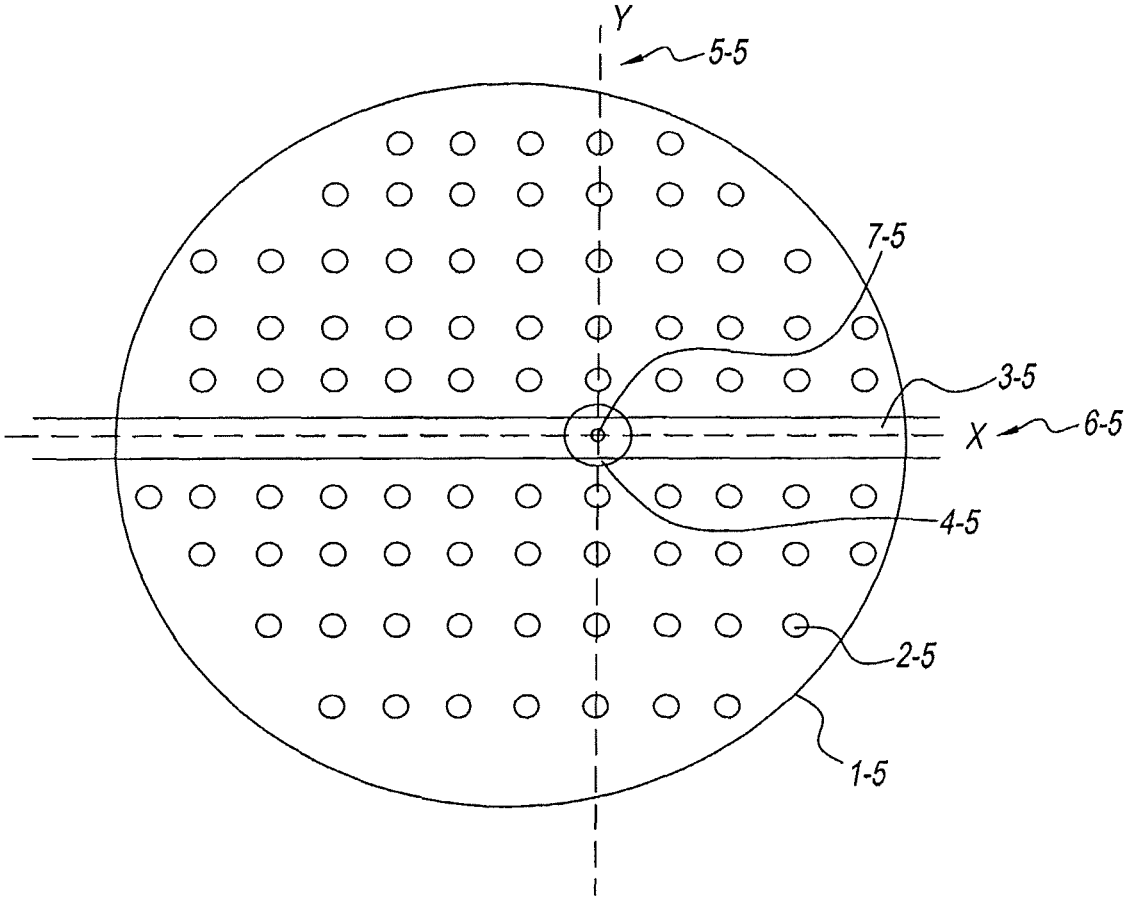
FIG. 5 illustrates a locator of the tube and shell heat exchanger cleaning system.

In another embodiment of the invention, a rectangular positioner 3-5 is illustrated in FIG. 5. The tube and shell heat exchanger is identified in 1-5 as well as the respective tubes 2-5 located in the heat exchanger. The plunger 4-5 is moved along two straight rails: straight horizontal rail along 6-5 line and another straight vertical rail along 5-5 line. This motion is executed by either electric or hydraulic motors. The position of any tube in 2D space could be described by selecting coordinates from a coordinate system (x, y). Once the correct (x, y) position designated as 7-5 of a tube is selected the plunger is plunged into that tube to seal it and do cleaning process. The overall shape of this rectangular positioning system is rectangular while FIG. 4 is substantially circular.

In FIG. 4A, the motor moves along the straight rail path to position the plunger at a particular tube after having the correct angular & radial position selected. Each tube has angular and radial position programmed into the controlling computer so that the straight rail and motor may rotate according to the designated tube that needs to be cleaned. In a two pass system, the fluid can enter and exit on the same side of the heat exchanger. In the two pass system, one side of the tube is partitioned into two half disks while the other end is a regular full disk. Because the two pass system of a heat exchanger contains a different construction than a single pass system, modifications to the positioner need to be made in order to accommodate the half disk design.

FIG. 4B illustrates the positioning system utilized for a two-pass system. In one embodiment, two translational motors move across a fixed rail 5-4 to select and position the plunger into a particular tube of the two pass system. The motor and selector of 1-4 includes rotational movement while the motor and selector of 3-4 include translational movement across the radius of the positioning system. 2-4 illustrates the rotational path the selector 1-4 follows. 4-4 illustrates the power and fluid control of the selector.

In another embodiment of the invention, a sensory system is used to check and verify the angular and radial positions of the positioner so that the positioner inserts the plunger into the correct tube at the correct angle to allow for maximum cleaning of each particular tube of the heat exchanger.

In another embodiment of the invention, the plenums of the heat exchanger are slightly enlarged to facilitate the positioner to have easy access to peripheral tubes. The cleaning system may be an insert between the plenum and the tube-sheet/base-plate.

Once the positioner locates and isolates a single tube in the heat exchanger, a plunger system that is attached to the positioner attaches to the tube. The plunger is anchored around the tube. In one embodiment, the plunger may enter the tube slightly. In another embodiment, the plunger does not enter the tube but rather the plunger attaches itself to the outer perimeter of the tube. The plunger structure includes materials such as but not limited to a rubber shoed cylinder. The rubber material of the plunger allows for the plunger to be pushed around the tube in order to seal the plunger around the tube. The shoe is slightly larger than the tube but small enough not to cover the neighboring tubes. The cleaning elements enter the tube through the plunger. The cleaning elements are connected by a cable/umbilical cord.

In one embodiment of the invention, the cleaning system may include one plunger and one positioner in which the cleaning system enters one side of the tube of the heat exchanger.

In another embodiment, there are two positioners and two plungers in which the cleaning system enters both sides of a tube. A first positioner and a first plunger enter one side of the tube and a second positioner and a second plunger enter the other side of the tube. Only the first positioner and first plunger contain the motor that holds the cable of the cleaning element of the cleaning system. With two plungers, a special fluid circulation of different flow rate and possibly different fluid could be established. The cleaning debris could also be caught and cleaned out. With only one positioner and one plunger then the cleaning fluid mixes from the other side with the heat-exchanging medium. There is only a limited flow control.

Figure 15:
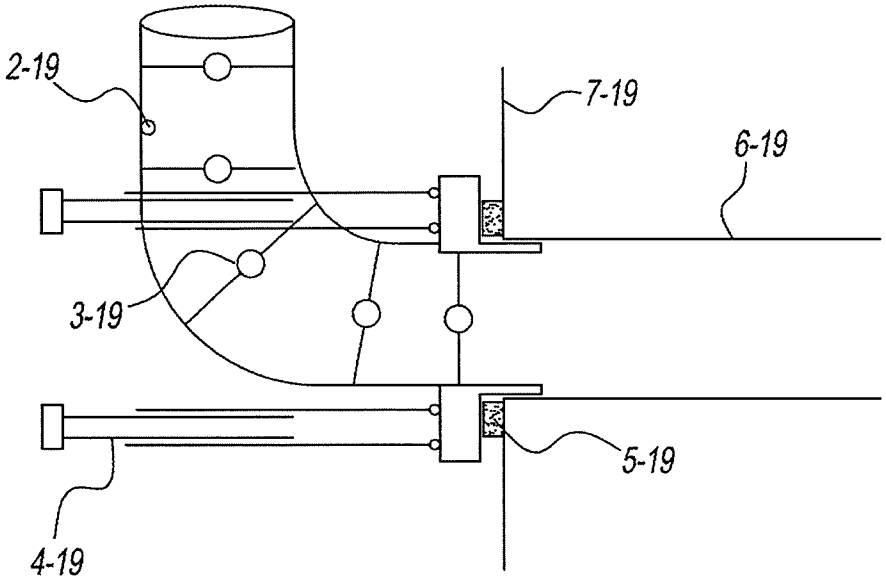
FIG. 15 illustrates the cable support system of the cleaning system.

The flow established in the tube through both plungers moves the brush. However, this motion is controlled because the allowed length is determined by the motor holding the rolled cable. The plunger is hollow to allow the flow of a fluid circulation and allow a cable-connected brush to go through the plunger as illustrated in FIG. 15.

Figure 6:
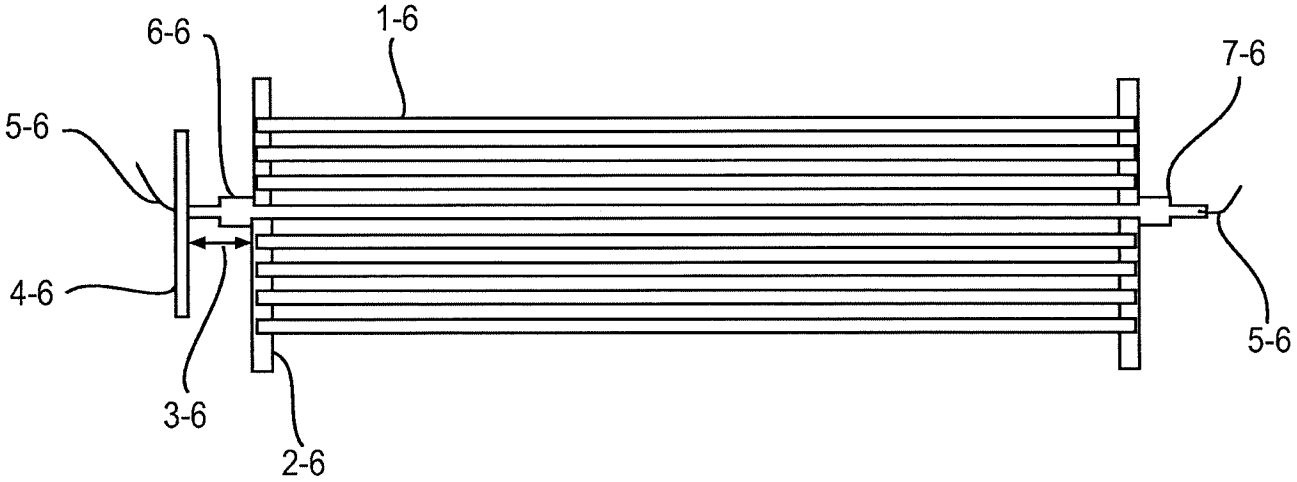
FIG. 6 illustrates a plunger of the tube and shell heat exchanger cleaning system.

A plunger is connected to the positioner. FIG. 6 illustrates an embodiment of the invention in which there are two plungers and two positioners of the cleaning system inserted into both ends of the tube of the heat exchanger. A first plunger 6-6 is inserted through the tube sheet 2-6 and into the tube 1-6 of the tube and shell heat exchanger (see explanation above). A second plunger 7-6 is inserted through the tube sheet and into the other end of the tube 1-6 of the tube and shell heat exchanger. The distance 3-6 indicates the length between the tube sheet and the cleaning system 4-6. The plunger fills the distance 3-6 and inserts into the tube 1-6. A cleaning element 5-6 may be inserted through the first plunger system. The cleaning element 5-6 may also be inserted through the second plunger system through the other end of the tube. The plunger attaches to the tube through the use of a motor. There is only one motor for the cleaning system and the motor may be used to attach the first plunger 6-6 or the second plunger 7-6. The motor allows motion of the cleaning system by releasing the cable. The cleaning cable is moved through the plunger into the tube of the heat exchanger by the fluid movement in the tube. The plunger is comprised or covered by a soft material such as rubber. The rubber material is located at the base of the plunger in order to seal well with the base plate.

In another embodiment of the invention, a cable connected to a plunger is inserted into the tube of the heat exchanger once the plunger connects to the base of the heat exchanger and attaches and isolates a particular tube. The cable includes cleaning elements including but not limited to nozzles, wire brushes, and ultrasonic transducers.

Figure 7:
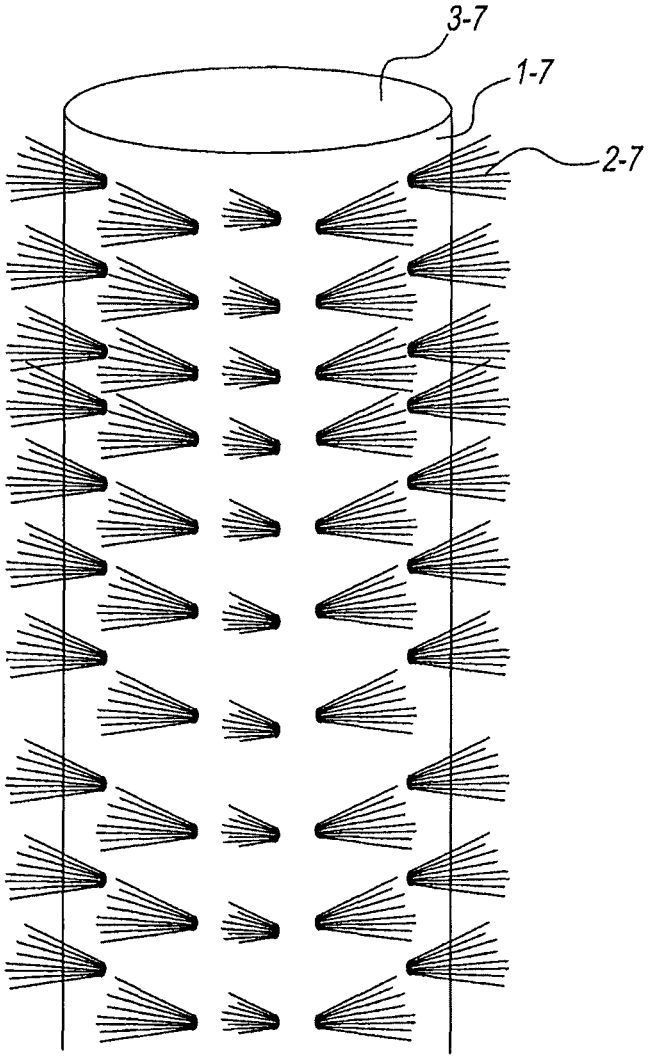
FIG. 7 illustrates a cleaning element of the cleaning system.

FIG. 7 illustrates an example of a cable comprising of a cleaning material. Small wire brushes 2-7 are placed along the cable 1-7 in bundles and act as the cleaning element. The cable is of a cylindrical shape 3-7. Wire brushes clean the tubes of the system by creating friction on the tubes to rid the tubes of built up scaling and debris. Cleaning nozzles spray a liquid into the tubes in order to apply pressure onto the buildup inside the tube and disperse the buildup thus eliminating built up debris. Ultrasonic transducers generate high frequency sound waves which cause the tubes to vibrate and energize fluid present in the tube undergoing cleaning. Vibration of a tube shakes off the built up debris and disperses it into the liquid flowing into the tube.

The plunger connects the isolated tube to an external circulation system 10-19 that is part of the cleaning system. Isolating individual tubes with a controlled circulation enables effective cleaning. The external circulation system 10-19 filters out the debris that is accumulated from the cleaning system with a filter 11-19 once the cleaning system is activated in each particular tube. The functional unit of the external circulation system is located outside the heat exchanger while cleaning the tube. Circulation of the external system is controlled by flow rate, pressure and type of fluid, and may be monitored by a diagnostic tool fitted to the cleaning system 9-19.

When referring to flow rate of the external system, a specific forward flow helps make the tension in the cord of the cleaning system and moves the implement forward into the tube of the heat exchanger. A fast flow rate of the external system controls the rotational rate of the rotating brush. A slow or reversed flow eases retrieval of the cleaning element. The external cleaning system includes methods of cleaning the tubes but is not limited to protective chemicals or abrasive materials could be used to carry out the cleaning process. Such protective chemicals include but are not limited to organic and inorganic solvents, acids and bases such as strong acids or chlorine based liquids. Such abrasive materials include but are not limited to minerals. Also, a coating material may be applied to the tube in order to effectively clean the tube.

Figure 10B:
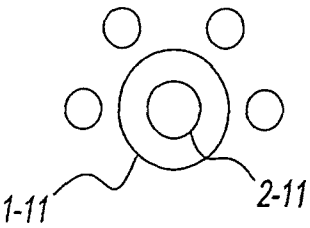
FIG. 10B illustrates a cross section of a tube of the heat exchanger.

The plunger is comprised of a soft-ended tube. The diameter of the plunger is larger than a single tube but small enough not to include neighboring tubes in the circulation. This is illustrated in FIG. 10B. Once in correct position, the plunger is mechanically pushed against the tube sheet so the plunger may attach to the tube sheet and can insert a cleaning mechanism into the tube. FIG. 10B demonstrates the diameter of the plunger when attached to a tube. The diameter of the plunger 1-11 preferably is larger than the diameter of the tube 2-11. The mechanical apparatus that pushes the plunger against the tube sheet may be a motor or from hydraulic action located outside the heat exchanger system. The plunger never enters the tube of the heat exchanger. Once the plunger is sealed to the tube sheet, a fluid flow is established in the particular tube. Fluid flow pushes the cleaning element into the tube. The cleaning element is attached to an umbilical cable. The position of the cleaning element is controlled by holding the umbilical cable. The plunger stays at the mouth of the tube until the cleaning operation is completed. Once cleaning is completed, the cable is withdrawn from the tube and then the plunger is retracted from the exterior of the tube.

With the positioner and the plunger in place, a cleaning element attached to a cord is allowed to flow in the tube. The cleaning element enters the tube by fluid flow pressure of the fluid in the heat exchanger pipes. The pressure against the plunger pulls the cleaning element into the tube. Once the cleaning element enters the tube, the pressure from the fluid flow keeps the cleaning element stable and prevents the cleaning element from exiting the tube prematurely. A balance of flow and the speed of cord release control the motion. The flow also is utilized to create a rotation action by a turbine as in turbo molecular pumps. The rotation revolves a brush in the tube to remove scaling or bio-matter that could have adhered to the tube internal surface. The flow rate, determined by the circulation through the tube and/or the heat exchanger, controls the rotational speed of the brush. Plunger width is defined as the width of the plunger from the heat exchanger pipe to the end of the plunger once attached to the heat exchanger pipe. Axial displacement occurs through compression when the plunger is retracted from the tube and also when is the plunger seals the tube.

Figure 8:
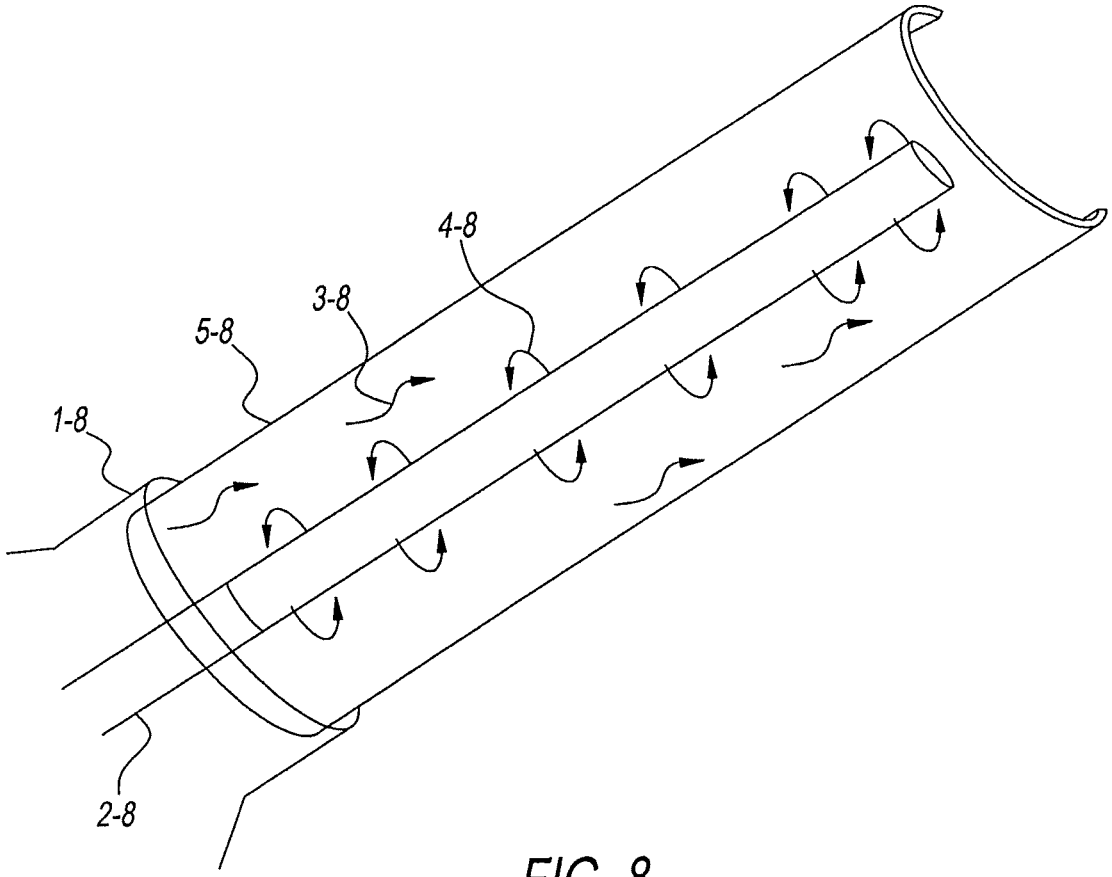
FIG. 8 illustrates the rotational movement of the cleaning element of the cleaning system.

FIG. 8 illustrates the rotational movement of the cleaning element 2-8 while cleaning the tube and shell heat exchanger 5-8. The plunger 1-8 attaches onto the entrance of the tube 5-8. Once attached, the cleaning element 2-8 is inserted by a cable and through the plunger and into the tube. Rotational movement 4-8 of the cleaning element 2-8 is induced through fluid flow rate 3-8 that passes through the plunger 1-8 and into the tube.

Other methods of cleaning the tube include but are not limited to sending a non-rotating element 8-16 and utilization of ultrasonic resonator to shake off the tube clean. In this embodiment of the invention, the cleaning element includes a motor attached at the end of the cleaning element. The motor vibrates the cleaning element which initiates a sonicating movement of the cleaning element against the tubes. Vibration from the sonicating movement cleans the tubes.

Figure 9:
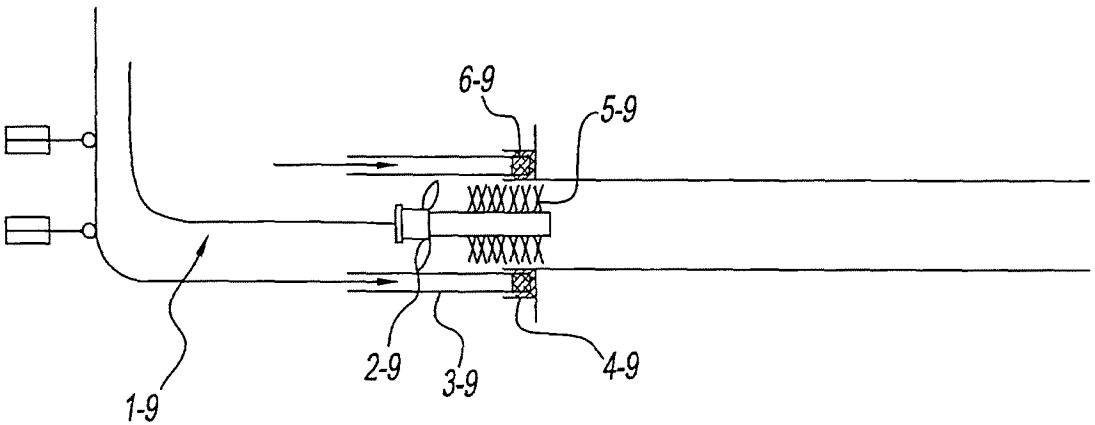
FIG. 9 illustrates the cleaning element and the plunger of the cleaning system.

FIG. 9 is a schematic of the cleaning system that is attached and inserted into the tube to clean the tube. The plunger body 3-9 attaches onto the exterior of the tube. The plunger includes a plurality of attachment devices 4-9 that circle around the tube so the plunger may attach to the tube. The attachment devices 4-9 are preferably made of soft rubber. A plate 6-9 attaches the attachment devices 4-9 and the plunger 3-9 to the tube of the heat exchanger. Once the plunger 3-9 is attached to the tube, the cable 1-9 containing a cleaning element 5-9 and turbine fins 2-9 is inserted into the tube of the heat exchanger.

Figure 10C:
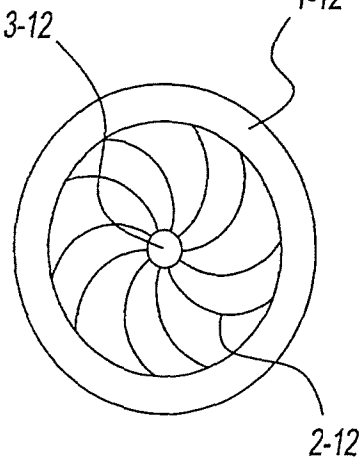
FIG. 10C illustrates the support base of the cable of the cleaning system.
Figure 10A:
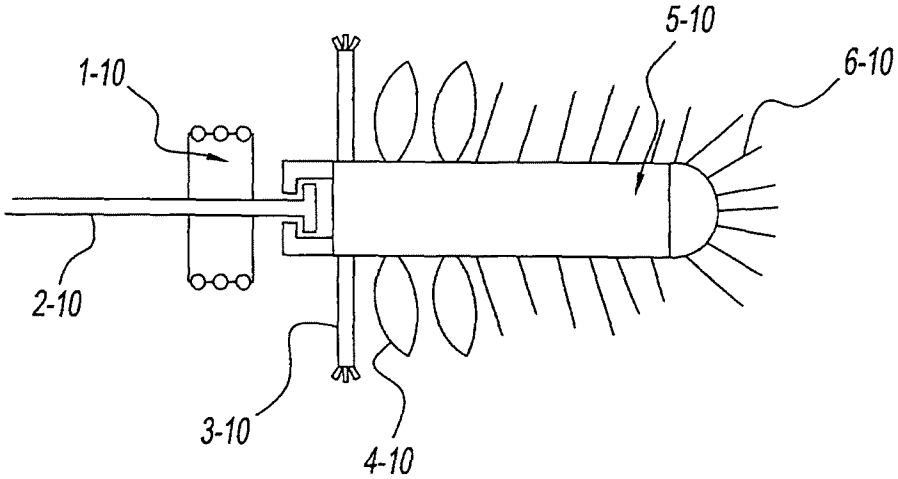
FIG. 10A illustrates a cleaning element of the cleaning system.

FIG. 10A illustrates a cleaning element that is used to clean the tube. The cable 2-10 is attached to a cleaning element. The cleaning element includes a brush 5-10 with bristles 6-10 of different lengths and positioned at different angles with respect to the brush so that the brush may rotate and clean the tubes of the heat exchanger. The sleeve 1-10 centers the cable 2-10 so that it may be inserted into the tube. The moving guide 3-10 and turbine fins 4-10 may include a rotational movement cause by flow rate once inside the tube. There may be a plurality of moving guides 3-10. Preferably, there are four moving guides attached to the cleaning element. The moving guides 3-10 prevent the turbine fins 4-10 from directly contacting the surface of the tube of the heat exchanger. The turbine fins 4-10 help create rotational movement from the flow. The rotational action of the brush allows for the cleaning of the tube.

Figure 14:
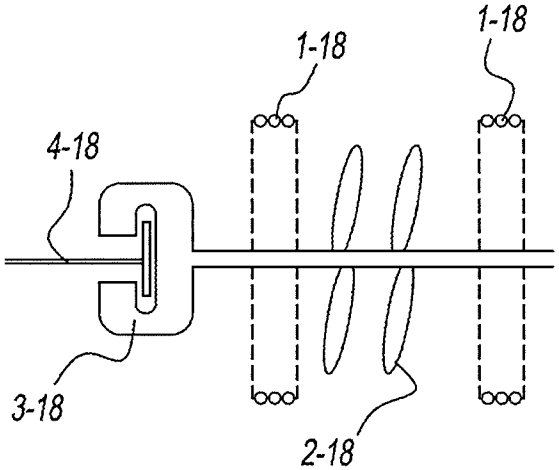
FIG. 14 illustrates the cleaning element.

FIG. 10C is an illustration of the support base 1-12 of the cable attached to the cleaning element; cable 2-10 of FIG. 10A. The turbine fins 2-12 create a rotational movement that allows fluid to pass through. A hole 3-12 of the cleaning element is structured as a fixed guiding hole so that the cable may move it as illustrated in FIG. 15. FIG. 10C is a preferred embodiment of the invention as it may create a swirling movement of the fluid through the plunger and into the tube. This support base 1-12 is fixed from its rim and the cable moves through it as in part 3-19 of FIG. 15. Another form of cable support base is fixed to cable or cleaning implement but could slide against the tube surface as shown in FIG. 11B. This dynamic support base is also shown in FIG. 14 part 1-18.

Figure 11A:
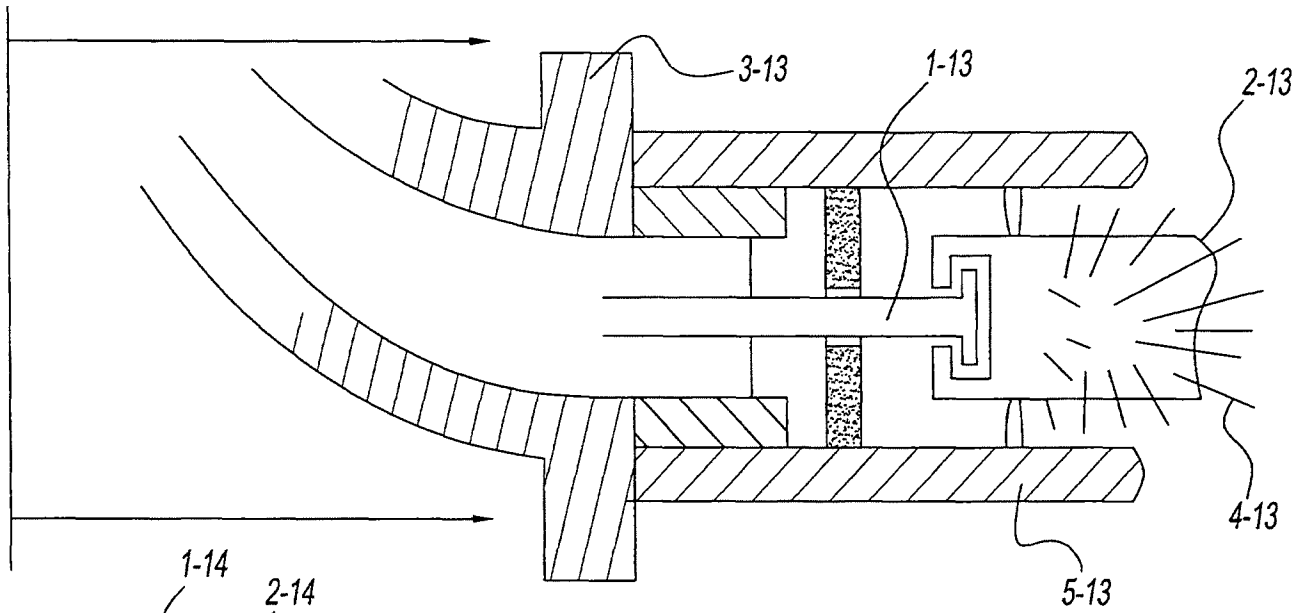
FIG. 11A illustrates the cleaning element and the plunger of the cleaning system.

FIG. 11A illustrates another embodiment of the cleaning element that is inserted into the tube of the heat exchanger. The cleaning element 2-13 includes a brush with bristles 4-13 of different lengths and positioned at different angles with respect to the brush so that the brush may rotate and clean the tubes of the heat exchanger. The cleaning element 2-13 is inserted into the tube 5-13 through a plunger 3-13. The cleaning element is attached to a cable 1-13.

Figure 11C:
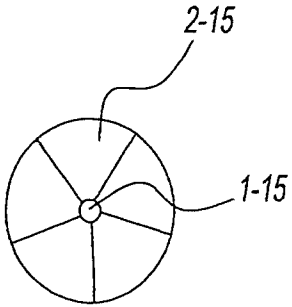
FIG. 11C illustrates a cable support of the cleaning element.
Figure 11B:
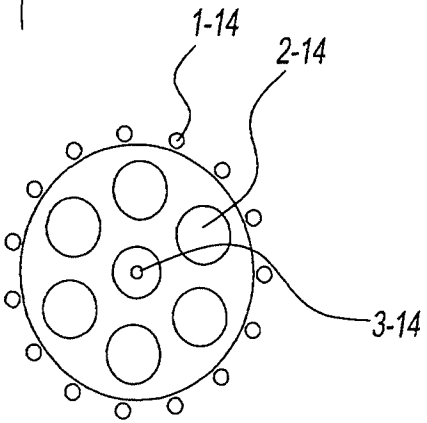
FIG. 11B illustrates a cable support of the cleaning system.

FIG. 11B illustrates a moving cable support of the cleaning system. The cable guiding hole 3-14 allows for fluid flow and is the location of the attachment of the cable to the cleaning element. Wires 1-14 attached to the cleaning element rotate and clean the tubes. A plurality of open holes 2-14 allow for fluid flow through the cleaning element. FIG. 11C illustrates another embodiment of a cable support base of the cleaning mechanism. The cable guiding hole 1-15 allows for straight support of fluid flow through triangular inlets 2-15. The cable guiding hole 1-15 of the cleaning element is structured as a fixed guiding hole so that it may move through the cable guiding holes as illustrated in FIG. 15 If the guide is stationary as in FIG. 15 then the cable flosses the central hole. If the guide is moving then the cable is fixed to the cable and its rim has rotating elements as in 7-16 of FIG. 12.

Figure 12:
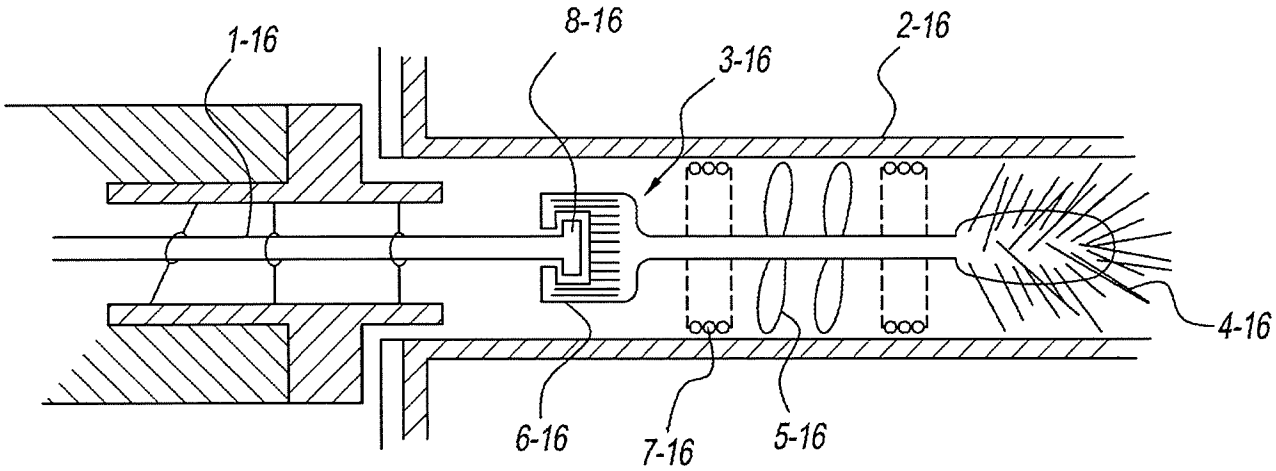
FIG. 12 illustrates the cleaning system when inserted into the tube of the heat exchanger.

FIG. 12 illustrates the cleaning element when inserted into a tube of the heat exchanger system. The cleaning element 4-16 is inserted into the tube 2-16. The cable 1-16 inserts the cleaning element into the tube 2-16. A bearing structure 6-16 holds the structure of the cleaning element 4-16 in the proper position to clean the tube. Moving guides 7-16 allow the turbine blades 5-16 to move in the tube without hitting the tube surface. They must have holes to allow fluid to flow through them. The moving guides 7-16 may rotate with respect to the tube and may comprise a rotary ending near the tube surface. The moving guides direct the fluid flow through the cleaning element to allow for cleaning of the tube. The cleaning element 4-16 includes a wire brush that rotates by a moving cable support 3-16. The turbine blades 5-16 cause rotation from fluid flow. The cable 1-16 preferably does not rotate.

Figure 13:
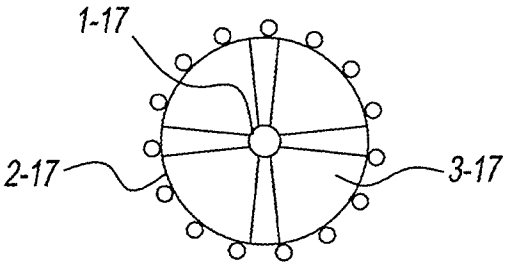
FIG. 13 illustrates a moving brush support of the cleaning system.

FIG. 13 is an axial view of the moving guide of FIG. 12. The moving guide does not clean the heat exchanger. The moving guide allows fluid to pass through the spaces in the moving guide. The rollers 2-17 allow the moving guide to slide above the tube surface. The hole 1-17 is fixed to the cable. Fluid flows through the fluid passageway 3-17 which creates directional movement of the fluid and of the cleaning system. 10C is the shape the creates most directional change to the fluid flow. Rotating rim elements are not drawn here (so it is a fixed guide) if drawn then it becomes a moving guide.

FIG. 14 illustrates another embodiment of the cleaning element. A bearing 3-18 attaches the cleaning element to a cable 4-18. Moving guides 1-18 allows blades to move in the tube without hitting the tube surface. They must have holes to allow fluid flow through them. Moving guides 1-18 allow direct the fluid flow through the cleaning element to allow for cleaning of the tube. Turbine fins 2-18 cause the rotational movement of the cleaning element.

Figure 16:
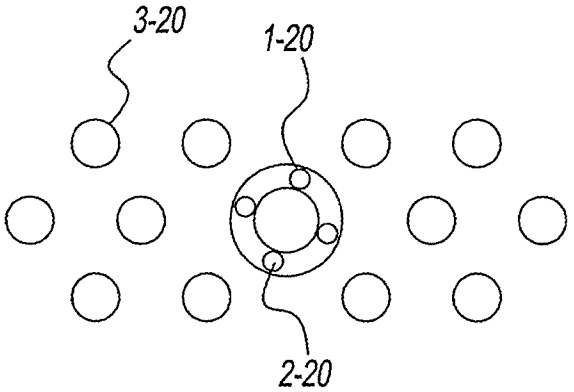
FIG. 16 illustrates a cross section of the plunger mechanism attached to the tube of the heat exchanger.
Figure 18:
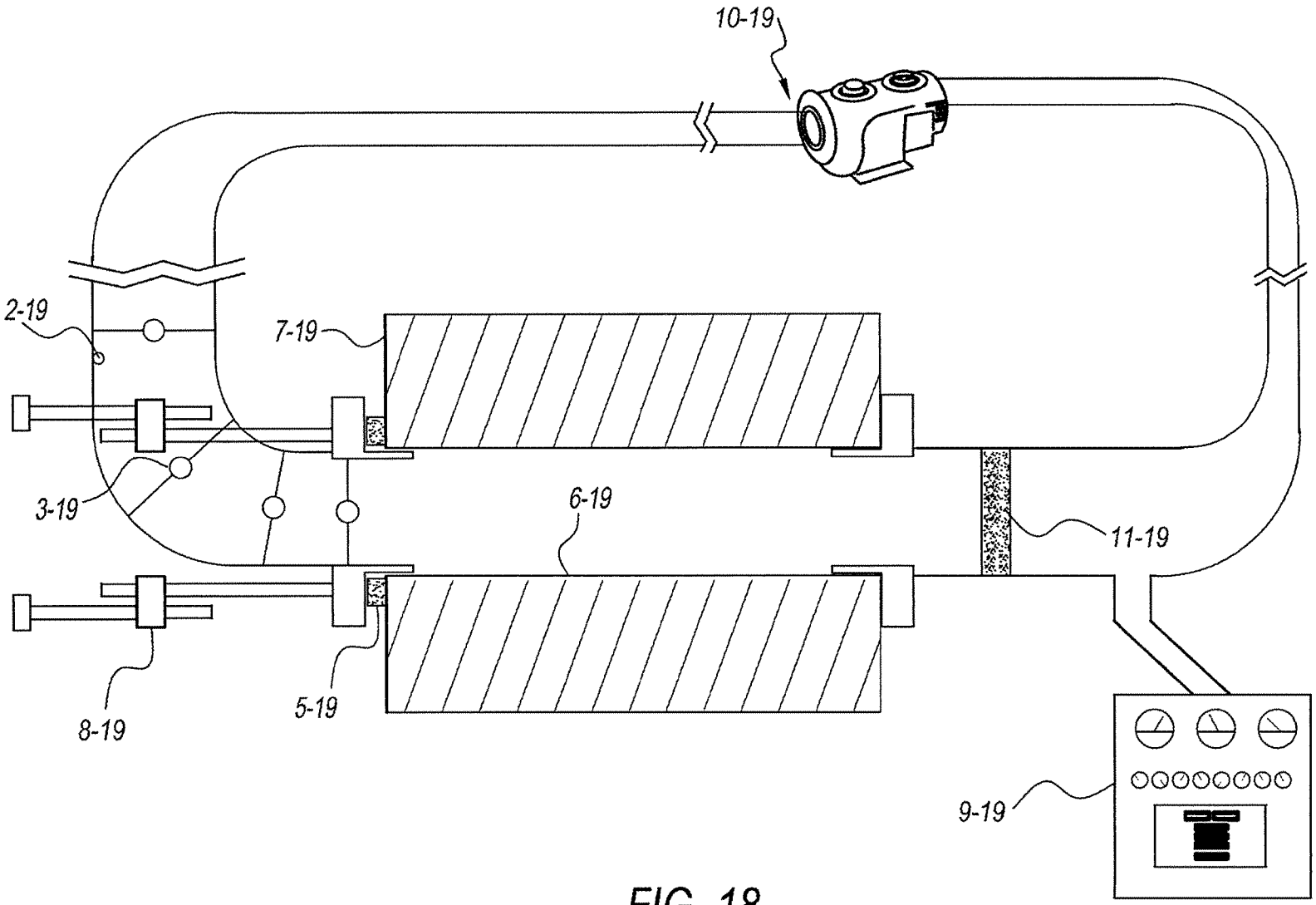
FIG. 18 illustrates the cleaning system with the plunger mechanism, motor, filter, external circulation system, and diagnostic tool.

FIGS. 15 and 18 illustrate the cable support and plunger system of the cleaning system. The plunger 2-19 attaches to the plate 7-19 of the tube 6-19. The plunger 2-19 includes cable guiding holes 3-19 that guide the cable through the plunger and into the tube of the heat exchanger. The cable guiding holes 3-19 also allow for fluid to pass through the cleaning system into the tube of the heat exchanger. The plunger attaches to the plate 7-19 through a hydraulic press 4-19 or motor 8-19 attached to a rubber padding 5-19. The hydraulic press 4-19 or motor 8-19 pushes the plunger against the plate 7-19 of the tube. A plurality of hydraulic presses encompasses the perimeter of the plunger to attach to multiple attachment points of the tube plate 7-19. The rubber padding 5-19 allows for better attachment of the hydraulic press 4-19 onto the tube 7-19. FIG. 16 illustrates a cross-section of the plunging mechanism. The plunger 1-20 attaches to a tube of the heat exchanger 3-20. The hydraulic press piston 2-20 seals the plunger onto the plate of the tube 1-20. The plunger has a diameter that is preferably larger than the diameter of the tube of the heat exchanger system.

Figure 17B:
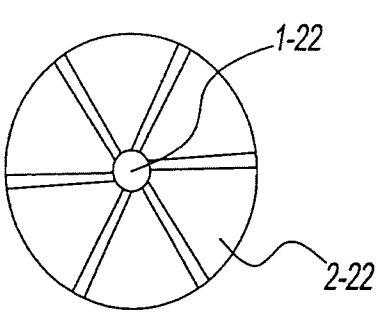
FIGS. 17A-17C illustrate cable guiding holes for the plunger mechanism.
Figure 17C:
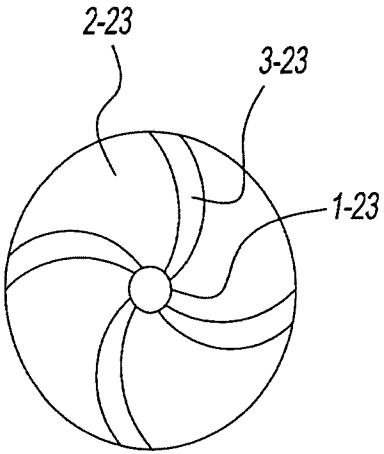
Figure 17A:
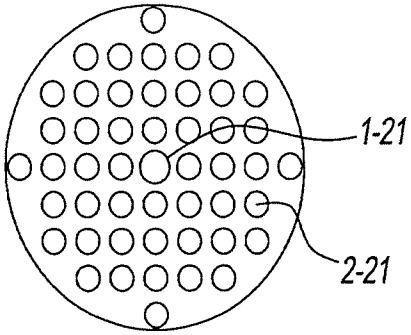

FIGS. 17A-17C illustrate embodiments of different cable-guiding mechanisms for the plunging mechanism. FIG. 17A illustrates a cable-guiding hole 1-21. The cable-guiding hole 1-21 allows for the cable to pass through the hole and into the tube. A plurality of holes 2-21 allow for fluid flow through the plunger mechanism. FIG. 17B illustrates a straight support cable-guiding mechanism. The cable-guiding hole 1-22 allows for the cable to enter through the hole and into the tube. Various inlets 2-22 allow for fluid flow through the plunger mechanism. The various inlets are of geometric shape but are not circular. Preferably, the various inlets are of equal size and proportion. FIG. 17C illustrates a cable-guiding mechanism with a swirl-shaped support. The cable-guiding hole 1-23 allows for the cable to enter through the hole and into the tube. The inlets 2-23 allow for fluid flow in a swirling or rotational movement through the plunging mechanism. The rotational movement of fluid flow is caused by a plurality of swirl supports 3-23.

In another embodiment of the invention, the cleaning system is used to clean other surfaces of the heat exchanger besides the internal tubes including the base plates at both ends of the heat exchanger and the annular and straight rail of the positioner of the cleaning system. The base plates on both ends must be maintained and kept clean in order to ensure that the plunger properly seals the individual tubes of the heat exchanger when the cleaning system is in operation. The annular rail and the straight rail surfaces must be maintained and kept clean in order for the positioner to function properly and to allow for optimal cleaning.

The base plate is cleaned by an attachment adjacent to the plunger mechanism. When the plunger is tilted away from the surface of the heat exchanger, the cleaning attachment is brought closer to the base plate and cleans the base plate. Cleaning of the base plate by the attachment includes two motions made by the attachment. The motions include angular and radial motions to swipe the baseplate clean. However, if the plenum (water box) is made wider there is no need for tilt mechanism.

The rails are cleaned by a separate attachment connected to the plunger mechanism. The ultrasound transducer cleans the sensitive toothed line in the rail. The separate attachment is only activated intermittently as need, as the rails do not need to be cleaned as often as the tubes of the heat exchanger.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. An online cleaning system with connected cleaning elements configured to clean an online tube and shell heat exchanger comprising:

a positioner that locates and isolates a tube of the online tube and shell heat exchanger, wherein the positioner includes an annular rail sliding on a fixed rail support fixed on a face of the online tube and shell heat exchanger;

an angular selector that rotates the annular rail to a rotational position according to a (r, θ) coordinate selection system;

a plunger that is connected to the positioner that is configured to attach to the tube of the online tube and shell heat exchanger while the online tube and shell heat exchanger is online; and a plurality of cleaning elements connected by a cable that is configured to pass through the plunger and into the tube of the online tube and shell heat exchanger and is mechanized by circulation of a fluid passing through the tube while the online tube and shell heat exchanger is in operation.

2. The online cleaning system of claim 1, wherein:

the circulation of the fluid passing through the tube creates a rotation action by a turbine present on each of the plurality of cleaning elements to clean the tube.

3. The online cleaning system of claim 1, wherein:

the plunger includes a motor positioned to extend a length of the plunger;

the plunger comprises a soft material at a base configured to seal with a base plate of the heat exchanger; and the plunger connects the tube to an external circulation system.

4. The online cleaning system of claim 3, wherein the flow rate of the fluid controls a rotational rate of a rotational brush present on each of the plurality of cleaning elements.

5. The online cleaning system of claim 1, wherein:

the plurality of cleaning elements comprises at least one from the group consisting of a non-rotating element;

an ultrasonic resonator;

a nozzle; and a wire brush.

6. The online cleaning system of claim 1, further comprising:

a filter attached externally to the online tube and shell heat exchanger, wherein the filter is configured to filter contaminates from the fluid.

7. The online cleaning system of claim 1, further comprising:

a diagnostic tool fitted to the online cleaning system.

* * * * *